US005894949A

United States Patent [19]

Taskis et al.

[11] Patent Number: 5,894,949

[45] Date of Patent: Apr. 20, 1999

[54] CONTAINER FOR PHARMACEUTICAL SUBSTANCES

[75] Inventors: Charles Bernard Taskis; Paul John Whatmore, both of Worthing, United Kingdom

[73] Assignee: SmithKline Beecham p.l.c., Brentford, United Kingdom

[21] Appl. No.: 08/718,300

[22] PCT Filed: Mar. 13, 1995

[86] PCT No.: PCT/EP95/00941

§ 371 Date: Sep. 12, 1996

§ 102(e) Date: Sep. 12, 1996

[87] PCT Pub. No.: WO95/25045

PCT Pub. Date: Sep. 21, 1995

[30] Foreign Application Priority Data

Mar. 17, 1994 [GB] United Kingdom ..... 9405249

[51] Int. Cl.[6] ..... B65D 41/20

[52] U.S. Cl. ..... 215/247; 215/261; 215/308; 220/371; 220/522

[58] Field of Search ..... 215/247, 248, 215/261, 308, 364; 220/371, 522

[56] References Cited

U.S. PATENT DOCUMENTS

| | | | |
|---|---|---|---|
| 2,186,908 | 1/1940 | Page et al. | 215/248 |
| 3,722,188 | 3/1973 | Cullen . | |
| 4,261,474 | 4/1981 | Cohen | 215/308 X |
| 4,545,492 | 10/1985 | Firestone | 215/308 X |
| 4,815,619 | 3/1989 | Turner et al. . | |
| 4,934,545 | 6/1990 | Pezzoli et al. | 215/308 X |
| 5,522,155 | 6/1996 | Jones | 34/286 |

FOREIGN PATENT DOCUMENTS

| | | |
|---|---|---|
| 0 131 147 A1 | 1/1985 | European Pat. Off. . |
| 274578 | 7/1927 | United Kingdom . |

*Primary Examiner*—Jes F. Pascua

*Attorney, Agent, or Firm*—Janice E. Williams; Charles M. Kinzig

[57] ABSTRACT

A container having a closure comprising a closure wall having a puncturable region in communication with the interior of the vessel, and having on an inwardly facing region of the closure wall a desiccant material separated from the interior of the vessel by a semi-permeable membrane which permits transmission of water vapor therethrough but is substantially impermeable to liquid water.

16 Claims, 2 Drawing Sheets

CONTAINER FOR PHARMACEUTICAL SUBSTANCES

BACKGROUND OF THE INVENTION

This invention relates to containers, particularly to containers for moisture sensitive materials particularly pharmaceutical substances.

It is frequently necessary to store moisture sensitive materials for relatively long periods in containers. In a particular example, certain pharmaceutical substances are supplied and/or stored in small vials containing one or more unit doses of the dry substance, and having a puncturable seal through which a hypodermic needle may be inserted. By means of such a needle water may be injected into the vial, the substance dissolved in situ, and the solution then withdrawn via the needle into a syringe for short-term use before hydrolysis of the moisture sensitive material. Such puncturable seals enable this operation to be sterile. During storage the presence of atmospheric moisture within the container, or the ingress of atmospheric moisture, can cause decomposition of such materials.

Often moisture sensitive pharmaceutical substances are provided in containers together with an internal desiccant in the container, for example a small sachet of molecular sieve or silica gel. Clearly this is not practical when the substance has to be made up in situ within the container as described above, as contamination by desiccant on dissolution of the substance is likely.

An example of a moisture sensitive pharmaceutical substance is clavulanic acid and its salts, such as potassium clavulanate. Potassium clavulanate is both hygroscopic and readily hydrolysed by water, so for handling and long term storage of potassium clavulanate it is necessary for the immediate environment to be kept extremely dry, e.g. 30% Relative Humidity ("RH") or less.

Potassium clavulanate is a β-lactamase inhibitor, and is often provided in a formulation in combination with a partner β-lactam antibiotic. A partner which is often used in such formulations is amoxycillin. For injectable formulations, which may be dry reconstitutable powders or oily suspensions for i.m. injection amoxycillin is used in the form of sodium amoxycillin. In some forms sodium amoxycillin is a powerful desiccant, and when contained together with potassium clavulanate in a sealed vial such forms of sodium amoxycillin can exert a dehydrating effect which helps to preserve the potassium clavulanate. Other forms of sodium amoxycillin, such as the anhydrous crystalline form disclosed in EP 0131147 B are less desiccating, and although it would be desirable to use such forms in formulations together with potassium clavulanate, the problem arises that these forms can be insufficiently desiccating to protect the potassium clavulanate.

BRIEF SUMMARY OF THE INVENTION

It is an object of this invention to provide a container having an internal desiccant which inter alia is suitable for use with moisture sensitive pharmaceutical substances and allows sterile dissolution without the problem of contamination by desiccant. Other objects and advantages of the invention will be apparent from the following description.

According to this invention, a container comprises a vessel having a mouth opening and a closure capable of sealing engagement with the mouth opening, the closure comprising a closure wall having a puncturable region therein in communication with the interior of the vessel, and having on an inwardly facing region of the closure wall a desiccant material separated from the interior of the vessel by a semi-permeable membrane which permits transmission of water vapour therethrough but is substantially impermeable to liquid water.

The term "inwardly" used herein refers to directions toward the interior of the vessel unless otherwise defined.

By means of the invention, moisture-sensitive substances within the vessel may be protected by the desiccant material, and water may be introduced into the vessel by means of a hypodermic needle puncturing the puncturable region of the closure face. The substance within the vial may then be dispersed or dissolved, whilst the membrane prevents the desiccant from contacting the introduced water, so as to dissolve the substance without any contamination by the desiccant.

The vessel may suitably comprise a vial of generally conventional construction, with a neck and a mouth opening being defined by the rim of the neck of the vial. Such a vial may be made of conventional materials such as glass, rigid plastics materials etc. The vial should be made of materials which are substantially impermeable to atmospheric water vapour, or at most allow only slow ingress of water vapour in quantities which can be absorbed by the desiccant without an undesirable degree of hydrolysis of the moisture-sensitive contents. Glass is particularly suitable as a vial material.

The closure may be made of generally conventional materials, preferably pharmaceutically acceptable materials, such as plastics materials, elastomeric materials etc., or composite materials such as metal and plastics or elastomeric materials. Preferably the closure is made of plastics or elastomeric materials which are of low moisture content, of low moisture permeability and low moisture affinity. Preferably the closure is at least partly, more preferably wholly more of an elastomeric material such as a natural or synthetic rubber, thereby allowing a tight compression fit with the mouth of the vessel. The sealing engagement of the closure with the mouth opening may be by a generally conventional construction e.g. similar to a conventional stopper. For example the closure may be engaged with the rim of the neck of a vial by a screw thread, a friction/compression fitting, or a circlip-type clamp around the neck of the vial. Such constructions are known in the art. The closure may seal the mouth in a generally conventional manner, e.g. by a compression fitting of the closure wall against the rim of the mouth, or by a sealing ring compressed between the closure face and the rim of the mouth etc.

The puncturable region of the closure wall may suitably comprise a thinned region of the closure wall, and is preferably provided in a region of elastomeric material which can resiliently seal around a hypodermic needle which is inserted therethrough, so as to facilitate sterile insertion and withdrawal. The region of elastomeric material may be of integral construction with the remainder to the closure.

The desiccant may be essentially conventional, and should be a material which does not normally give off fumes or readily form fine powdery particles either inherently or as a result of absorbing water. Conventional materials may be used, for example molecular sieves or silica gel.

To allow the puncturable region of the closure face to be in direct communication with the interior of the vessel, the distribution of the desiccant material may be such that the desiccant is located on only part of the closure wall, so that the puncturable region is situated between areas of the closure wall on which is the desiccant material, or beside of such an area. By such a construction a hypodermic needle may be inserted through the puncturable region of the closure wall without coming into contact with the desiccating material, whilst the desiccating material itself is in desiccating communication with the interior of the vessel through the membrane.

In one embodiment of the invention, the desiccating material may be distributed in the form of, or about, a ring shape on the closure wall, with the puncturable region within, e.g. near or at the centre of, the ring. Such a ring shape may for example be circular, polygonal, or oval etc., suitably conforming to the general internal section of the closure. Such a ring-shaped distribution of desiccant may be located in a corresponding ring-shaped holder or cavity in the closure wall, or alternatively a ring-shaped distribution of desiccant may be located in a holder defining a ring-shaped cavity which extends inwardly from the closure wall, the cavity opening into the interior of the container when the closure is in place on the vessel. Such a holder may suitably be in the form of two generally concentric walls extending inwardly from the closure wall, the space between the walls defining the ring-shaped cavity, and the central space within the inner wall defining a central passage in direct communication with the puncturable region, down which a hypodermic needle may be inserted. Such a holder may be formed integrally with the closure wall, or may be separate part of the closure.

Closures for pharmaceutical vials are commonly in the form of a closure wall across the mouth of the vial, from which integrally extends a shirt which sealingly engages the internal surface of the neck of the vial. In the closure of this invention the skirt of such a conventional closure may suitably be made in the form of the above described two generally concentric walls to form a holder.

Suitably the outer surface of the outer wall may be constructed so as to engage the rim of the neck and/or mouth, suitably contributing to the sealing engagement of the closure and the vessel. Suitably both the said generally concentric walls may be integral with the closure wall, so that the closure wall forms the base of the cavity and of the central passage. Suitably in such a construction the base wall of the central passage includes the puncturable region.

The nature and quantity of desiccant material used in the container of the invention will vary with the nature of the moisture sensitive contents, and can easily be determined by straightforward experimentation or calculation, e.g. from the moisture content of the contents of the vessel. In the case of potassium clavulanate and its mixtures with amoxycillin, e.g. crystalline anhydrous sodium amoxycillin, molecular sieve is a suitable desiccant. Suitably the desiccant material may be compacted into a ring shape, for example by compression, sintering, binders etc., either by forming a hard compact prior to insertion into the cavity, or by forming such a compact in situ within the cavity in the closure face by in situ compression. Methods of forming such compacts comprising desiccant materials are known. The desiccant may for example be introduced into the mould, and the closure made by moulding around it.

The membrane is preferably substantially permeable to water vapour, such that the RH within the vessel is kept at a level at which a moisture sensitive material, such as a moisture sensitive pharmaceutical substance is protected from hydrolysis to the extent that long term storage with an acceptably small level of hydrolysis can be achieved. The membrane may allow permeation of moisture vapour from the interior of the vessel to the desiccant material at a rate which desiccates the contents before significant degradation occurs.

By "substantially impermeable to liquid water" in the context of this invention is meant membranes which are water insoluble and completely and permanently impenetrable by liquid water. The term also includes membranes which, whilst in a long term would dissolve or allow liquid water through, in practice during the few seconds or minutes whilst liquid water is in contact with the membrane during the action of dissolving a moisture sensitive pharmaceutical substance contained in the vessel, as described herein, do not permit any liquid water through, or permit so little that no significant contact of water with the desiccant occurs which might cause contamination of the solution of the pharmaceutical substance. The term also includes membranes with permeability characteristics between these two extremes. Suitably the membrane material should be pharmaceutically acceptable.

The semi-permeable membrane may be a continuous film of material or a microporous material. The semi-permeable membrane may for example be a thin film of a plastics material. Suitable plastics material, which when thin enough are semi-permeable, allowing water vapour to pass through at a rate which permits suitable desiccation whilst being substantially impermeable to liquid water to penetrate, are known. Suitable plastics materials include for example polyolefins, such as polyethylene or polypropylene, polystyrene, polyamides, polyesters and halogenated polyvinyls such as polyvinyl chloride.

Such a membrane may be provided as a coating over the desiccant, or over areas on the closure face on which the desiccant is located, or over part of the cavity which opens out into the interior of the vessel when the closure is in place. When the cavity is a ring-shaped cavity, for example a cavity defined in a holder as described above, the membrane may cover the opening of the cavity into the interior of the vessel.

In addition to covering the opening of a ring-shaped cavity into the interior of the vessel, the membrane may also cover the central space within the ring shape, e.g. within the inner wall of a ring shaped holder as described above, i.e. the central passage down which a hypodermic needle may pass. This may advantageously enable the membrane to be made more conveniently in the form of a disc generally corresponding to the circular shape of the closure, rather than a ring shape, and consequently the disc shaped membrane may lie between the puncturable region and the interior of the vessel. Such a membrane should therefore be easily puncturable by the hypodermic needle. The presence of such a membrane across the central passage may assist in reducing withdrawal losses.

The membrane may be attached to the closure material by conventional methods such as welding, adhesives etc., or alternately physically attached by for example pinching into slots etc. in the closure material, or pinching between parts of the closure, or between the closure and the vessel, or physical cohesion between the membrane material and the closure material.

It may also be possible for the membrane to be integral with the closure, i.e. made of the same plastics or elastomeric material as the closure. In such an embodiment the material of the closure may be such that when in the form of a thin film it is semi-permeable as described above, but when in bulk or in a thicker form it is substantially impermeable as described above. In such an embodiment the desiccant may be present in the mould as the closure and integral membrane are formed, or the membrane may be integrally moulded on after the closure is moulded with the desiccant material in situ.

It is usually a requirement of containers such as vials for use with injectible pharmaceutical substances that all parts of the vial and their closure are washable to remove particulates, and sterilisable. The container of the present invention provides for this in that a rapid wash may be used followed by rapid drying. This can remove particulates but maintains the semi permeable membrane in contact with liquid water for only a short time, as discussed above, so that liquid water does not permeate through the membrane. Sterilisation of the containers and their closures is possible using gamma radiation. When this method of sterilisation is used, it should be ensured that the materials of which the container and closure, including the membrane and the desiccant, are stable to the amounts of gamma radiation used.

The container of the invention is particularly suitable for the containment of moisture-sensitive pharmaceutical substances such as a formulation of potassium clavulanate and sodium amoxycillin, particularly anhydrous crystalline sodium amoxycillin e.g. as disclosed in EP 0131147. Such a formulation may be dry solids for reconstitution with water, or an oily non-aqueous suspension for i.m. injection.

The invention therefore further provides a container as described above, containing a mixture which comprises potassium clavulanate and sodium amoxycillin.

The closure of the invention, independent of the vessel, is also believed to be novel, and therefore the invention further provides a closure capable of sealing engagement with the mouth opening of a vessel, the closure comprising a closure wall having a puncturable region therein arranged so as to be in communication with the interior of a vessel on which the closure is in place, and having on an inwardly facing region of the closure wall a desiccant material covered with a semi-permeable membrane which permits transmission of water vapour therethrough but is substantially impermeable to liquid water.

Suitable and preferred forms of the closure are as described above.

BRIEF DESCRIPTION OF THE INVENTION

The invention will now be described by way of example only with reference to the accompanying drawings, which show:

FIG. 1 a longitudinal section through a vial and closure of the invention.

FIG. 2 a sectional view through the closure of FIG. 1 about the line A—A of FIG. 1 looking in the direction of the arrows.

FIG. 3 a longitudinal section through an alternative construction of the closure of the invention.

FIG. 4 a longitudinal section through another alternative construction of the closure of the invention.

DETAILED DESCRIPTION OF THE INVENTION

Figure 1:
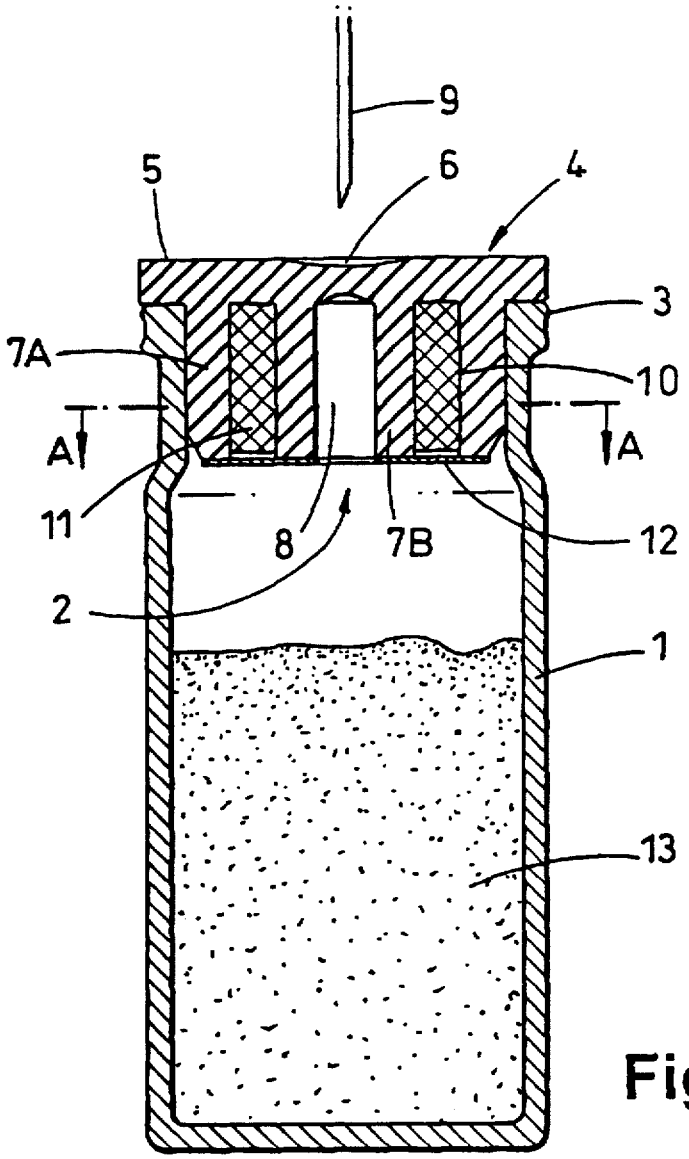
Figure 2:
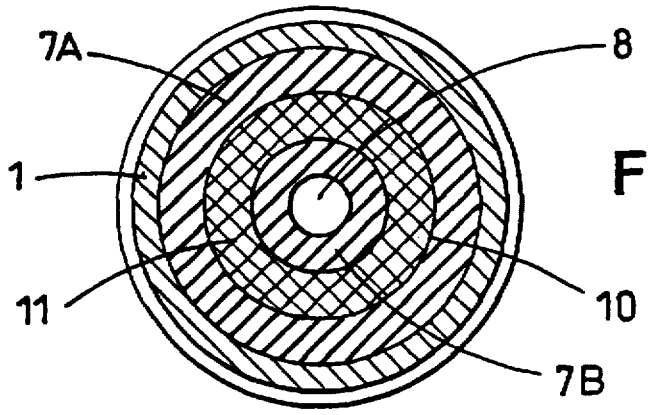

Referring to FIGS. 1 and 2, a glass vial (1) has a mouth opening (2) defined by the rim of a neck (3). In the neck (3) of the vial (1) is a closure (4 generally) integrally made of a synthetic rubber material which comprises a closure wall (5) which sealingly engages the rim of the mouth opening (2). Centrally located in the closure wall (5) is a thinned puncturable region (6).

Extending inwardly into the vial (1) from the closure wall (5) is an integral holder (7) in the form of two concentric walls (7A, 7B) the outer of which (7A) at its periphery sealingly engages the neck (3) with a compression fit. The holder (7) is generally in the shape of the conventional skirt of a conventional elastomeric closure for a vial (1) made in the form of the two concentric walls (7A, 7B). The inner wall (7B) surrounds a central space (8) with the puncturable region (6) at its top. A hypodermic needle (9) may be inserted through the puncturable region (6) and passed along the passage into the vial defined by the space (8).

Between the inner and outer walls (7A, 7B) is a ring-shaped cavity (10) which contains a compacted desiccant (11). The opening of the cavity (10) into the interior of the vial (1) is closed by a thin, semi-permeable membrane (12) being a film of a plastics material which allows water vapour to pass through, thereby allowing the desiccant (11) to exert its desiccating effect on the interior of the vial (1) and to keep it at a low relative humidity. The membrane (12) is compression and heat welded to the walls (7A, 7B). Alternatively the membrane (12) may be mechanically pinched into slits (not shown) in the walls (7A, 7B), or fastened thereto by a pharmaceutically acceptable adhesive (now shown). The thickness of the membrane (12) is shown exaggerated.

Figure 3:
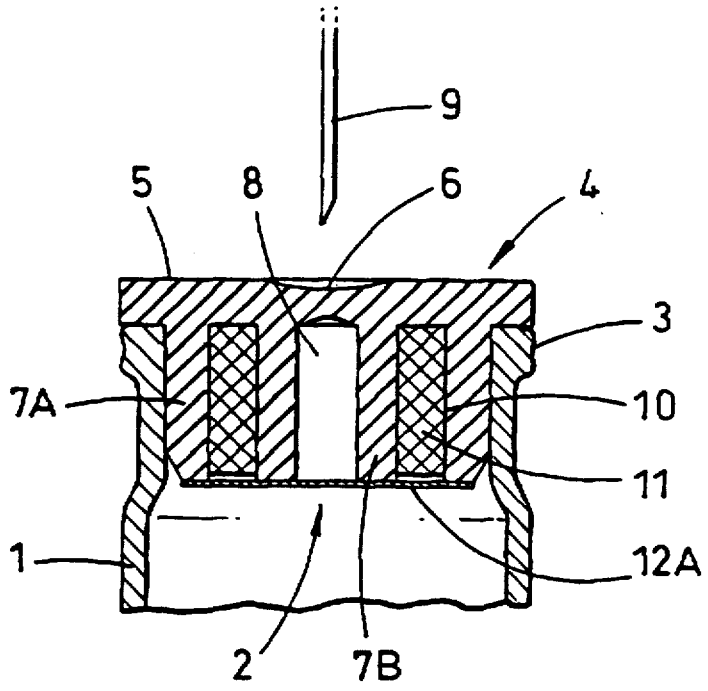

Referring to FIG. 3 the upper part of a combination of a vial (1) and closure (4) are shown. Parts corresponding to FIGS. 1 and 2 are numbered correspondingly. The membrane (12A) is in the form of a thin disc shaped film of a plastics material which allows water vapour to pass through, thereby allowing the desiccant (11) to exert its desiccating effect on the interior of the vial (1) and to keep it at a low relative humidity. The membrane (12A) covers the central passage (8) within walls (7B) and is thin enough to be punctured by the hypodermic needle (9) when this is inserted into the vial through puncturable region (6). The membrane (12A) is compression and heat welded to the walls (7A, 7B), although alternative methods of attachment as described above could be used.

Figure 4:
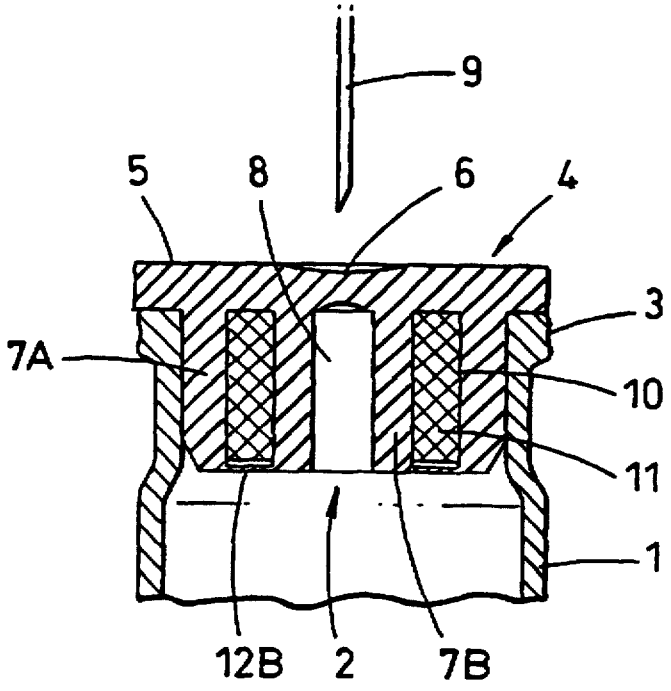

Referring to FIG. 4 the upper part of a combination of a vial (1) and closure (4) are shown. Parts corresponding to FIGS. 1 and 2 are numbered correspondingly. The membrane (12B) is integrally moulded with the closure (4), and is hence made of the same polymeric material, which in bulk form, i.e. as in the closure wall (5) and walls (7) is substantially impermeable to water vapour, but when in the form of a thin film such as the membrane (12B) is semi-permeable as described above.

In cross section the closures (4) of FIGS. 3 and 4 are identical to FIG. 2, and the thickness of the membrane (12A, 12B) is again shown exaggerated.

The closure wall (5) may be fastened tightly against the rim of the neck (3) by means of a surrounding thin metal circlip (not shown) of conventional construction as used with known vials.

Cavity (10) may be strengthened by integral radial braces (not shown) bridging the walls (7A, 7B). In another embodiment (not shown) a holder for the desiccant (11) may be made as a separate part in the form of two walls analogous in shape to walls (7A, 7B) with a cavity (10) and desiccant (11) between them closed by a membrane (12), and by a base wall.

In use, the hypodermic needle (9) is inserted through the puncturable region (6), and along the passage (8), also puncturing the membrane (12A) of the embodiment of FIG. 3, into the vicinity of the contents (13) of the vial (1), a dry mixture of potassium clavulanate and anhydrous crystalline sodium amoxycillin. Sterile water is injected down the needle (9) to dissolve the contents (13), and as the membrane (12, 12A, 12B) is impermeable to liquid water the vial may be shaken to encourage dissolution without causing the solution to be contaminated by contact with the desiccant (11). The solution may then be withdrawn through the needle (9) into a syringe (not shown) for subsequent use.

The closure (4) of FIGS. 1 to 4 may be made by injection moulding techniques which will be apparent to those skilled in the art, and the desiccant (11) may be introduced into the cavity (10) mechanically, followed by formation or attachment of the membrane (12).

We claim:

1. A container comprising a vessel having a mouth opening and a closure capable of sealing engagement with the mouth opening, the mouth opening being defined by the rim of the neck of the vessel, the closure comprising a closure wall having a puncturable region therein in communication with the interior of the vessel and comprising materials from the group consisting of plastic materials, elastomeric materials or composite metal and plastic or elastomeric materials, the puncturable region of the closure wall comprising a thinned elastomeric region which is capable of resiliently sealing around a hypodermic needle when said needle is inserted therethrough, and having on an inwardly facing region of the closure wall a desiccant material separated from the interior of the vessel by a semi-permeable membrane which permits transmission of water vapor therethrough but is substantially impermeable to liquid water.

2. A container according to claim 1 wherein the dessicant is located on only part of the closure wall and the puncturable region is situated between areas of the closure wall on which the desiccant is present.

3. A container according to claim 2 wherein the desiccant material is distributed in the form of a ring shape on the closure wall, with the puncturable region within the ring.

4. A container according to claim 3 characterised in that a ring-shaped distribution of desiccant is located in a holder defining a ring-shaped cavity which extends inwardly from the closure wall, the cavity opening into the interior of the container when the closure is in place on the vessel.

5. A container according to claim 4 wherein the holder is in the form of two generally concentric walls comprising an inner wall and an outer wall extending inwardly from the closure wall, the space between the walls defining the ring-shaped cavity, and the central space within the inner wall defining a central passage in direct communication with the puncturable region.

6. A container according to claim 5 characterised in that the holder is formed integrally with the closure wall.

7. A container according to claim 6 wherein the outer wall has an outer surface which engages the rim of the mouth.

8. A container according to claim 7 wherein the central passage has a base wall which includes the puncturable region.

9. A container according to claim 8 characterised in that the desiccant material is compacted into a ring shape.

10. A container according to claim 9 wherein the semi-permeable membrane is a continuous film of material.

11. A container according to claim 10 characterised in that the semi-permeable membrane is a thin film of a plastics material.

12. A container according to claim 11 wherein the plastics material is selected from the group consisting of polyolefins, polystyrene, polyamides, polyesters and halogenated polyvinyls.

13. A container according to claim 12 characterised in that the cavity is a ring-shaped cavity between generally concentric cavity-defining walls, and the membrane covers the opening of the cavity into the interior of the vessel.

14. A container according to claim 13 characterised in that in addition to covering the opening of the cavity into the interior of the vessel, the membrane also covers the central space within the ring.

15. A container according to claim 14 characterised in that the membrane is integral with the closure.

16. A container according to claim 15 characterised in that the container contains a formulation of potassium clavulanate and sodium amoxycillin.

* * * * *